US011149530B2

(12) United States Patent
Rodrigues et al.

(10) Patent No.: US 11,149,530 B2
(45) Date of Patent: Oct. 19, 2021

(54) SUBSEA SYSTEM AND METHOD FOR PRESSURIZATION OF A SUBSEA OIL RESERVE BY INJECTING AT LEAST ONE OF WATER AND GAS

(71) Applicant: PETROLEO BRASILEIRO S.A.—PETROBRAS, Rio de Janeiro (BR)

(72) Inventors: Roberto Rodrigues, Rio de Janeiro (BR); Helvio Ferreira Da Silva, Rio de Janeiro (BR); Joao Francisco Fleck Heck Britto, Rio de Janeiro (BR); Claudio Jose Godoy Mota Valenca, Rio de Janeiro (BR); Andre Stark De Almeida E Silva, Rio de Janeiro (BR); Sidnei Guerreiro Da Silva, Rio de Janeiro (BR); Elias Gava Colombo, Rio de Janeiro (BR); Ivan Noville Rocha Correa Lima, Rio de Janeiro (BR)

(73) Assignee: PETROLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 16/638,930

(22) PCT Filed: Aug. 14, 2017

(86) PCT No.: PCT/BR2017/000093
§ 371 (c)(1),
(2) Date: Feb. 27, 2020

(87) PCT Pub. No.: WO2019/033179
PCT Pub. Date: Feb. 21, 2019

(65) Prior Publication Data

US 2020/0190952 A1 Jun. 18, 2020

(51) Int. Cl.
*E21B 43/16* (2006.01)

(52) U.S. Cl.
CPC ..... *E21B 43/166* (2013.01)

(58) Field of Classification Search
CPC ..... E21B 43/16; E21B 43/166
See application file for complete search history.

(56) References Cited

U.S. PATENT DOCUMENTS 10,815,777 B2 * 10/2020 Collins ..... G01N 33/2823
2004/0244980 A1 * 12/2004 Appleford ..... E21B 43/18 166/305.1

(Continued)

FOREIGN PATENT DOCUMENTS

GB 2 302 107 A 1/1997
RU 2 441 977 C1 2/2012

(Continued)

*Primary Examiner* — Matthew R Buck
(74) *Attorney, Agent, or Firm* — J.A. Lindeman & Co., PLLC

(57) ABSTRACT

The present invention relates to the injection of water and gas, either simultaneously or alternately, into subsea wells in order to enhance production and the oil recovery level. Thus, the present invention provides a subsea system for pressurizing a subsea oil reservoir injecting at least one of water and gas, comprising (i) at least two subsea injection wells (4, 4'), each subsea injection well (4, 4') being connected to a production unit (5) by means of a single subsea line (1, 2) which is connected to the respective subsea injection well (4, 4') by a main injection mandrel (6, 6'), and (ii) at least one jumper (3), each jumper (3) hydraulically connecting two of the at least two adjacent subsea injection wells (4, 4') through annular mandrels (7, 7'). The present invention further provides a subsea reservoir pressurization method associated with the above-described system.

10 Claims, 3 Drawing Sheets

(56) References Cited

U.S. PATENT DOCUMENTS

| | | | | |
|---|---|---|---|---|
| 2013/0153038 | A1* | 6/2013 | Barden | F17D 1/08 137/1 |
| 2015/0233222 | A1 | 8/2015 | Teklu et al. | |
| 2018/0135400 | A1* | 5/2018 | Sommerfield | F04B 43/06 |

FOREIGN PATENT DOCUMENTS

| | | | |
|---|---|---|---|
| WO | 2004101945 | A1 | 11/2004 |
| WO | 2015030846 | A1 | 3/2015 |
| WO | 2015197422 | A2 | 12/2015 |

* cited by examiner

SUBSEA SYSTEM AND METHOD FOR PRESSURIZATION OF A SUBSEA OIL RESERVE BY INJECTING AT LEAST ONE OF WATER AND GAS

FIELD OF THE INVENTION

The present invention relates to fluid injection into oil reservoir for pressure maintenance. More particularly, the present invention relates to the injection of water and gas simultaneously or alternately into subsea wells to increase the production and oil recovery factor.

BACKGROUND OF THE INVENTION

In oil production at sea, to the extent the reservoir are produced, the pressure thereof decreases. In order to allow the continued production, there are several techniques of secondary oil recovery, among which it is worth mentioning water injection to minimize the material balance deficit and thus keep the pressure of the reservoir as near as possible the original pressure. Studies of production of oil fields in deep water with high gas-oil ratios, like those located in the Brazilian pre-salt area, identified the opportunity to increase reservoir recovery factors using for that the alternating injection method of gas and water in the same well and site of the reservoir, known as WAG (Water-Alternating-Gas). This method is used in several onshore fields, but not used in offshore fields.

Depending on the type of reservoir, WAG method can exhibit better oil recovery indexes compared with the water injection only method. There are some variants of the WAG method, including the simultaneous injection of gas and water in the same well.

An opportunity for WAG with $CO_2$-rich gas arises in Brazil, mainly in the recent discoveries of large oil resources in the pre-salt layer. Much of the oils contained in carbonate reservoirs of the pre-salt is lightweight, having a density in the range from 28 to 30° API—American Petroleum Institute, with a high quantity of gas, gas-oil ratio greater than 200 $m^3/m^3$, and containing between 8 and 20% $CO_2$, which makes the use of gas for the enhanced oil recovery an attractive possibility. The reinjection of the produced gas containing $CO_2$ through WAG injection method, is a good prospect to increase oil recovery factor of those reservoirs, in addition to mitigate the release of gases causing the greenhouse effect. A challenge is to apply this technique in deep water.

A problem inherent to the oil production at great depths, and also to gas and water injection systems in the same well involves the risk of plugging conducts due to hydrate formation, resulting from direct contact of gas and water under high pressure and low temperature conditions. Another problem of using a line to flow either gas or water, in case the gas contains a percentage of $CO_2$ above 1%, is the need for special metallurgy and operational procedures for switching fluid through displacement with pads of inert fluid beds, avoiding the $CO_2$ reacting with water to form carbonic acid, a substance highly corrosive.

To circumvent problems of corrosion in lines and risk of hydrate in the development of the first subsea fields in deepwater of Brazilian pre-salt, it was designed a flexible system capable of injecting only water or making alternate injection of water and gas (method WAG) having capabilities for switching the injected fluid and, consequently, mitigating the risk of hydrate formation. For such it was developed one Water and Gas injection Subsea Manifold (MSIAG) operating connected to two subsea injection wells. In this system, the manifolds are responsible for controlling the injection of gas and/or water in the wells.

Despite the merits of this design, such manifolds show a high investment cost in the order of $ 30 million, plus the cost of the subsea lines and operating costs. Thus, there is a need to develop new solutions that allow the maintenance of reservoir pressure under production.

Therefore, there is an interest in seeking other more cost-effective solutions without the need of a manifold to ensure injection via WAG method in scenarios like the one above-described, in this connection, multifunctional subsea systems, that is, conjugating injection to increase reservoir recovery factor with greater robustness to mitigate hydrates, and further with the possibility of injecting water taken up directly from the seafloor, can become attractive.

The document entitled "Advanced Petroleum Recovery: Potential of WAG (Water Alternating Gas), to ROSA, K. R. S. A., Bezerra, M. C. M., Ponzio, E. A. and Rocha, A. A., published by Rev. Virtual Quim. in 2016, describes a study of oil recovery using WAG injection techniques. However nothing is mentioned about the possibility of subsea injection in injection wells without the need of using the manifold to control injection.

As will be detailed below, the present invention aims to solve the above prior art problems described in a practical and efficient manner.

SUMMARY OF THE INVENTION

It is an object of present invention to provide an integrated recovery system for gas and water injection which releases the need of a subsea manifold.

It is an additional object of present invention to provide an integrated recovery system via injection of gas and water provided with greater robustness to hydrates.

It is an additional object of present invention to provide an integrated recovery system via injection of gas and water capable of injecting water taken up and treated directly from the seabed.

Thus, in order to achieve these objects, the present invention provides a subsea system for pressurizing a subsea oil reservoir by injection of at least one of water and gas, the system comprising (i) at least two subsea injection wells, each subsea injection well being connected to a production unit through a single submarine line that connects the respective subsea injection well through a main injection mandrel and (ii) at least one jumper each jumper connecting hydraulically two of the at least two adjacent subsea wells via injection annular mandrels.

The present invention further provides an subsea method for pressurizing a subsea oil reservoir by injection of at least one of water and gas, comprising the step of injecting at least one of water and gas in at least one subsea well for injection of an assembly comprised of at least two subsea injection wells, each subsea injection well being interconnected to a production unit by means of a single submarine line that connects to the respective subsea injection well via a main injection mandrel, wherein a jumper hydraulically connects two of the at least two adjacent subsea wells via injection annular mandrels, wherein the step of injecting at least one of water and gas in at least one subsea injection well is carried out from the production unit and respective single subsea line, or from a taking up and injecting subsea system in hydraulic communication with the at least one subsea injection well.

BRIEF DESCRIPTION OF THE FIGURES

The detailed description set forth below refers to the accompanying figures and the respective reference numerals thereof representing embodiments of the present invention.

DETAILED DESCRIPTION OF THE INVENTION

Firstly, it is emphasized that the following description describes preferred embodiments of the invention. As will be apparent to one skilled in the art, however, the invention is not limited to such particular embodiments.

Figure 1:
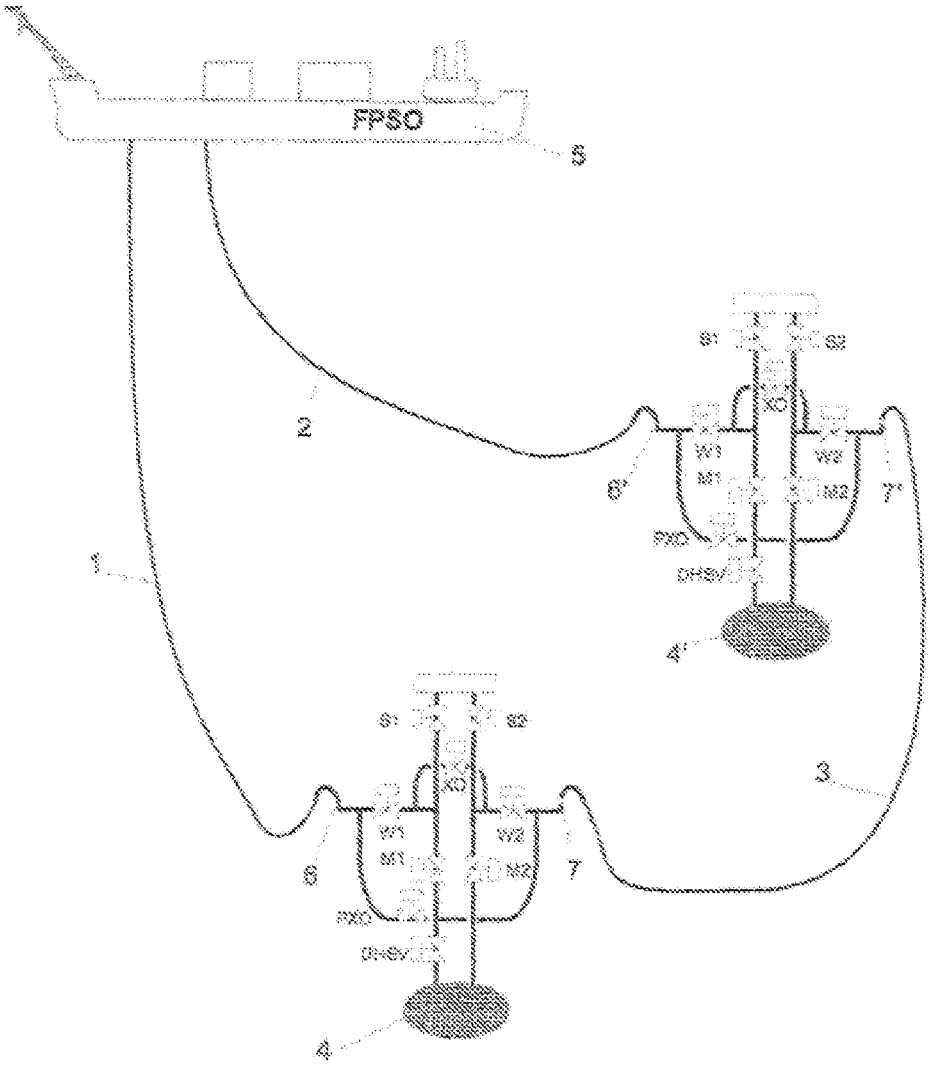
FIG. 1 illustrates a schematic view of a system according to a first embodiment of the present invention, comprising a pair of injecting wells hydraulically connected by single short subsea line (jumper).

In a first embodiment of present invention illustrated in the schematic view of FIG. 1, two subsea injection wells 4, 4' are interconnected to a production unit 5 such as a FPSO (Floating Production Storage and Offloading) through their respective subsea injection lines 1, 2 connected to respective main injection mandrels 6, 6' of each subsea injection wells 4, 4'. The wells 4 and 4' are connected hydraulically through a short subsea line, such as a jumper 3, which connects by annular mandrels 7, 7' of each of subsea injection wells 4, 4'.

The jumper 3 facilitates the switching and exchange of fluid in subsea lines 1, 2, facilitating the displacement of pads of inert fluids, for example: diesel.

Additionally, the jumper 3 enables the passage of tools and fluids through the subsea lines and subsea injection wells 4, 4', such as scraper, also known as pig. To facilitate understanding, further illustrates are the commonly existing valves in the assembly comprised of production base and wet Christmas tree installed in subsea wellheads, where:

M1—injection master valve;

M2—annular valve;

W1—main wing valve;

W2—annular wing valve;

S1—main swab valve;

S2—annular swab valve;

XO—cross over valve;

PXO—cross over pig valve;

DHSV—downhole safe valve.

Figure 2:
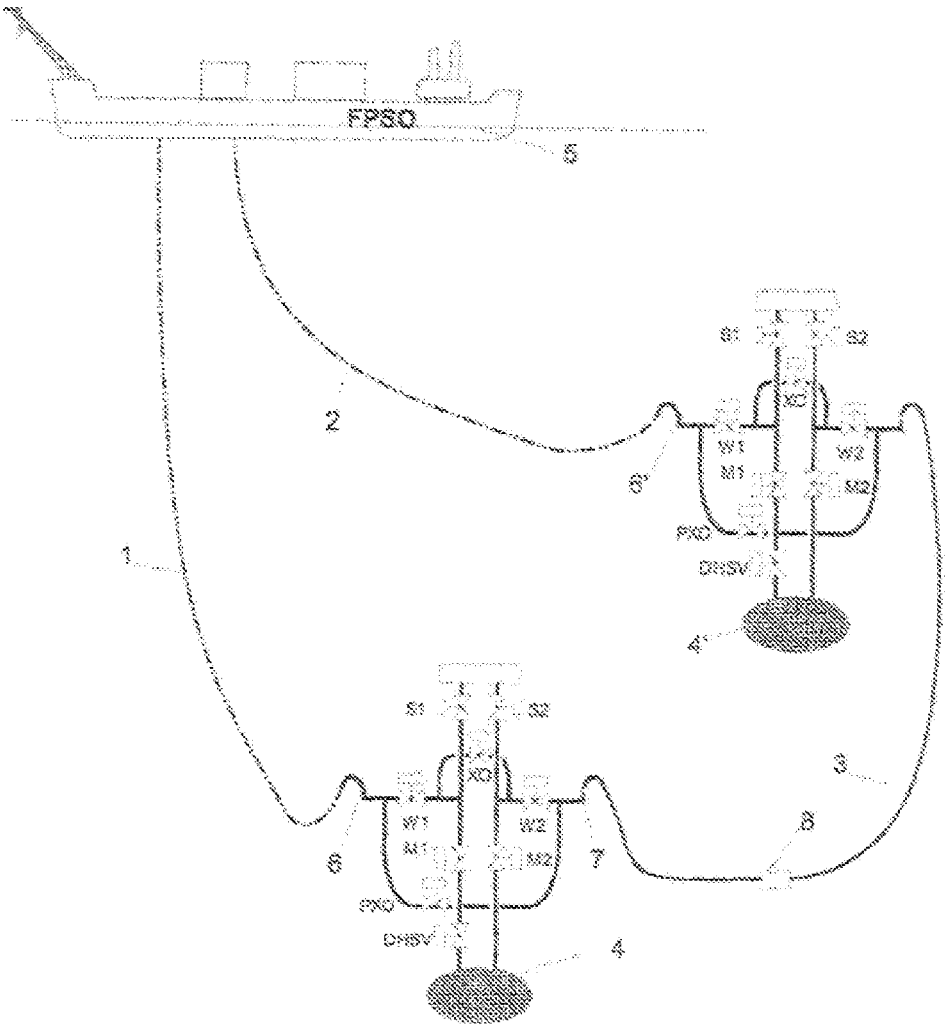
FIG. 2 illustrates a schematic view of the system according to a second embodiment of present invention, further comprising water taking up and injecting subsea system.
Figure 3:
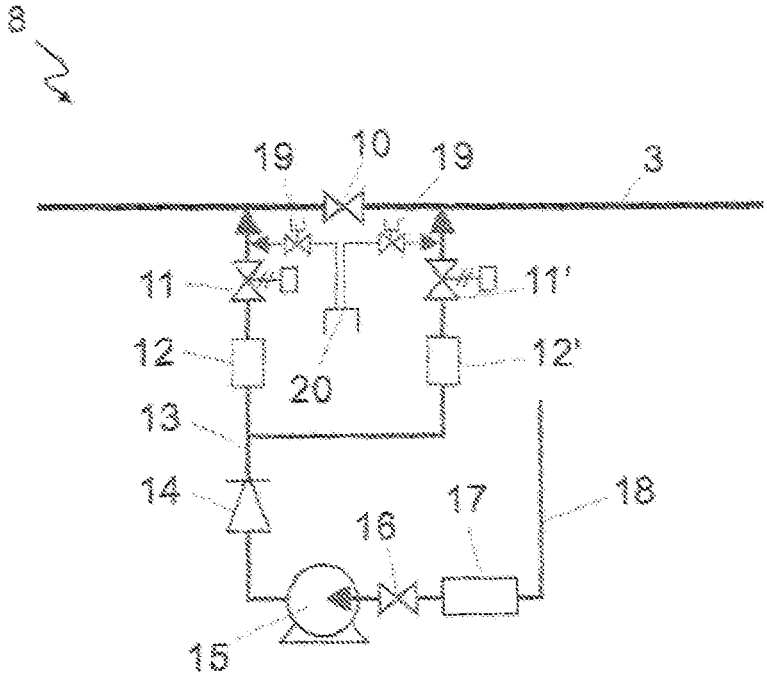
FIG. 3 illustrates a detailed schematic view of the water taking up and injecting subsea system of the second embodiment of the present invention.

Optionally, according to a second embodiment illustrated in the schematic view of FIG. 2, water is collected, filtered and injected directly from the seabed in each of the subsea injection wells 4, 4' through a taking up and injecting seawater subsea system 8.

Preferably, the taking up and injecting seawater subsea system 8 is in fluid communication with the annular mandrels 7, 7' of adjacent subsea injection wells 4,4' through at least one jumper 3. More preferably, the taking up and injecting seawater subsea system 8 is positioned along jumper 3, as shown in FIG. 2.

Preferably, the taking up and injecting seawater subsea system 8 comprises valve 10, chokes 11, 11', flow meters 12, 12', discharge pipe 13, check valve 14, injection pump 15, suction valve 16, filter 17 and suction pipe 18.

Optionally, at least one dual hydraulic tap 20, hot stab type, is used for the depressurizing operation and hydrate mitigation. Further optionally, auxiliary valves 19, 19' remotely operated by ROV (Remotely Operated Vehicle) are provided. Through the dual hydraulic tap 20 it is possible to draw fluid from one side of valve 10 and return to the other side, promoting depressurization on the desired side.

The present invention further provides a subsea method for pressurizing a subsea oil reservoir by injection of at least one of water and gas, comprising the step of injecting at least one of water and gas in at least one subsea injection well 4, 4' of an assembly comprised of at least two subsea injection wells 4, 4', each subsea injection well 4, 4' being interconnected to a production unit 5 through a single subsea line 1, 2 that connects to the respective subsea injection well 4, 4' via a main injection mandrel 6, 6'.

The method of present invention also relies on a jumper 3, connecting physically and hydraulically two of the at least two adjacent subsea injection wells 4, 4' through annular mandrels 7, 7', facilitating the operations of displacement and exchange of fluids in subsea lines 1 and 2, with or without pig passage.

Additionally, the step of injecting at least one of water and gas in at least one subsea injection well 4, 4' is carried out from the production unit 5 or from subsea taking up and injecting system 8 in hydraulic communication with the at least one subsea injection well 4, 4'.

Optionally, the injecting step comprises injecting continuously or alternately at least one of water and gas through the different single subsea lines 1, 2 only from the production unit 5.

Optionally, the alternate injection of at least one of water and gas through the different single subsea lines 1, 2 from the production unit 5 further comprises injecting inert fluid pads in the interfaces between water and gas. Preferably, the inert fluid is diesel oil.

Alternatively, the step of injecting comprises the injecting gas through different single subsea lines 1, 2 from the production unit 5 and injecting seawater from the subsea taking up and injecting system 8 in fluid communication with the at least one subsea injection well 4, 4'.

Therefore, it is pointed out that a number of technical advantages are obtained by the present invention, since the same:

(i) provides a subsea gas and water injection system designed to improve the recovery factor in petroleum production projects in deep water;

(ii) provides a subsea injection system that can inject one single fluid or more than one fluid alternately;

(iii) provides a subsea injection system and respective method that allows making alternate injection of gas or water, with displacement of fluid through the switching of the position of blocking valves located in the production unit and the wet Christmas trees of the injection wells;

(iv) simultaneously provides a method of injection and assurance of flow more robust facilitating depressurization of lines for the prevention or even remediation of hydrates;

(v) does not show technological obstacles with regard to the equipment used, since the system according to the present invention comprises integration of components and proven technologies; and (vi) provides a subsea injection system of water and gas alternately with a minimum number of connections and risers and without the need of manifold, significantly reducing the cost and complexity of construction, installation and maintenance.

A number of variations falling in the scope of protection of present application are allowed. Thus, it is emphasized that present invention is not limited to the particular embodiments/configurations described above.

The invention claimed is:

1. A subsea system for pressurizing a subsea oil reservoir injecting at least one of water and gas, the system comprising:

at least two subsea injection wells each of the subsea injection wells is interconnected to a production unit using a single submarine line that connects to each of the respective subsea injection wells through a main injection mandrel, and at least one jumper, wherein each jumper fluidly communicates directly between two of the at least two subsea injection wells through adjacent annular mandrels of the subsea injection wells.

2. A system according to claim 1, wherein the jumper further comprises a taking up and injecting seawater subsea system.

3. A system according to claim 2, wherein the taking up and injecting seawater subsea system comprises at least one valve, at least one choke, at least one flowmeter, a discharge pipe, a check valve, an injection pump, a suction valve, a filter and a suction pipe.

4. A system according to claim 2, wherein the taking up and injecting seawater subsea system is in fluid communication with the annular mandrels of the at least two adjacent subsea injection wells through the at least one jumper.

5. A system according to claim 2, wherein the taking up and injecting seawater subsea system further comprises at least one dual hydraulic tap.

6. A system according to claim 2, wherein the taking up and injecting seawater subsea system further comprises at least one auxiliary valve remotely operated by remotely operated vehicle (ROV).

7. A subsea method for pressurizing a subsea oil reservoir injecting at least one of water and gas, the method comprising:

injecting at least one of water and gas a subsea injection well of an assembly comprising at least two subsea injection wells, each of the subsea injection wells is interconnected to a production unit using a single submarine line which connects to each of the respective subsea injection wells via a main injection mandrel, wherein a jumper hydraulically connects two of the at least two adjacent subsea injection wells directly through annular mandrels, wherein the injecting of at least one of water and gas in the subsea injection well is from the production unit or from a subsea system for capturing and injecting in fluid communication with the at least one subsea injection well.

8. A method according to claim 7, wherein the injecting of at least one of water and gas into at least one subsea injection well comprises continuous or alternate injection of at least one of water and gas through the different single submarine lines from the production unit.

9. A method according to claim 8, wherein the alternate injection of at least one of water and gas through the different single submarine lines from the production unit further comprises the injection of pads of an inert fluid in the interfaces between water and gas.

10. A method according to claim 7, wherein the injecting comprises injecting gas through the different single submarine lines from the production unit and injecting seawater from the subsea system for capturing and injecting in fluid communication with the at least one subsea injection well.

* * * * *